US006385827B1

(12) United States Patent
Stewart et al.

(10) Patent No.: US 6,385,827 B1
(45) Date of Patent: May 14, 2002

(54) APPARATUS AND METHOD FOR TEXTURING YARN

(75) Inventors: Brad L. Stewart, Talking Rock; Doyle Thomas; Shane King, both of Crandall, all of GA (US)

(73) Assignee: Shaw Industries, Inc., Dalton, GA (US)

( * ) Notice: Subject to any disclaimer, the term of this patent is extended or adjusted under 35 U.S.C. 154(b) by 0 days.

(21) Appl. No.: 09/809,640

(22) Filed: Mar. 15, 2001

(51) Int. Cl.[7] ..... D02G 1/12
(52) U.S. Cl. ..... 28/263; 28/264; 28/267
(58) Field of Search ..... 28/263, 264, 265, 28/267, 268, 262, 254, 248, 250, 221

(56) References Cited

U.S. PATENT DOCUMENTS 2,734,228 A * 2/1956 Hay ..... 28/267
2,854,701 A * 10/1958 Rainard ..... 28/267
3,234,625 A * 2/1966 Trifunovic et al. ..... 28/264
3,305,897 A * 2/1967 Meibohm ..... 28/267
3,345,719 A * 10/1967 Schatz et al. ..... 28/264
3,553,803 A * 1/1971 Buschmann et al. ..... 28/267
3,616,503 A * 11/1971 Mattingly ..... 28/267
4,316,312 A * 2/1982 Vermeer et al. ..... 28/267
5,025,538 A * 6/1991 Saleh ..... 28/263
5,419,023 A * 5/1995 Hawkins et al. ..... 28/267
6,134,758 A * 10/2000 Raskin et al. ..... 28/264

* cited by examiner

*Primary Examiner*—Amy B. Vanatta
(74) *Attorney, Agent, or Firm*—Needle & Rosenberg, P.C.

(57) ABSTRACT

Method and apparatus for texturing yarns that encompasses, after stopping the moving yarns during normal operations, increasing the opening size of the outlet of the stuffer box, and injecting a fluid through the interior of the stuffer box. The fluid entrains some of the yarns remaining within the interior of the stuffer box to move at least a portion of the yarns outside of the stuffer box.

43 Claims, 4 Drawing Sheets

APPARATUS AND METHOD FOR TEXTURING YARN

SUMMARY OF THE INVENTION

The present invention encompasses an apparatus and method for minimizing or eliminating light streaks that appear in yarns tufted into a carpet, in which the undesired light streaks result from the yarn being overly crimped in a stuffer box after a shutdown of the production line. By decreasing the quantity and length of light streaks, the present invention reduces the amount of unacceptable carpet formed, which increases efficiency and saves carpet producers money.

As an overview, a large portion of carpets used in residences are known as pile carpets formed by tufting pile yarn into a primary backing material. The yarns tufted into the primary backing form the fibrous face of the carpet. The tufted loops can optionally be cut or sheared to form tufts of a desired, constant vertical height.

Two general categories of tufted carpets are (1) a textured style, in which the tufts and the individual filaments or staples have varying degrees of crimp or curl; and (2) a straight-set style, in which the filaments or staples at the tuft tip are straight and substantially perpendicular to the plane of the carpet face. Addressing the first category of carpets, yarn that is used as pile in textured style carpets is prepared by cabling together a plurality of single yarns and setting them in their twisted condition. One option is to use a stuffer box, or stuffer box crimper, to produce textured yarn having a desirable appearance and texture when tufted into the primary backing. The purpose of the stuffer box is to put texture in the twisted yarn. One major stuffer box brand uses the tradename Superba®.

During operation of such a stuffer box, uncrimped yarn is transported by a pair of counter-rotating nip rolls into and through a confined zone within the interior of the stuffer box. There, the yarn is caused to be folded and compressed into a fine crimp configuration. The crimps in the yarn can then be heat set, which "locks in" or sets the texture to make it of a lasting nature. The more the yarns are textured, the lighter the color because more light is reflected from the crimps and elbows formed into the yarns.

The latter type of carpet, the straight-set style, does not use a stuffer box in the production line. As such, the filaments or staples at the tuft tip are straight and substantially perpendicular to the plane of the carpet face. Without processing the yarns through a stuffer box and texturing the yarns prior to tufting into the primary backing, the untextured carpet has a darker appearance than if the same carpet was formed by the identical yarn strands processed in a stuffer box and then heat set.

The textured-style carpets are more popular than the straight-style carpet because, for example, the texturing characteristics assist in hiding footprints and vacuum tracks. The step of texturing the yarns with the stuffer box, however, creates some issues that do not exist when producing the straight-style carpet. One such recurring problem arises after a shutdown of the heat-set production line, which occurs periodically for doffing the winders, other planned line stops, and aberrant conditions that may arise during operations. Once operations resume, some of the yarns have a lighter appearance than yarns processed during normal operating conditions, i.e., before and after the shutdown.

It has been found that the yarns remaining within the stuffer box during and through the shutdown result in the lighter colors. This yarn obtains too much texture by remaining in the stuffer box longer than the normal processing time. The lighter appearance of the overly textured yarns is particularly apparent when they are tufted into the primary backing and appear as light streaks in fiberous face of the tufted carpets. This lighter section of the tufted carpet—located between yarns processed by the stuffer box during normal operations—is unacceptable from a quality-control standpoint and are not marketable.

The present invention addresses this problem in the art and eliminates or minimizes the amount of carpet that must be wasted as a result of overly texturing the yarn during a shutdown. More specifically, the present invention comprises an apparatus and method that involves opening the outlet of the stuffer box, immediately after shutdown and also injecting one or more bursts of a fluid, preferably air, into the stuffer box. The fluid passes through a portion of the stuffer box and out of the opened outlet, entraining some of the yarns remaining within the stuffer box after the shutdown. Some of these entrained yarns pass through the outlet to exit the interior of the stuffer box, where they remain permanently.

The portion of the yarns moved to outside of the stuffer box by the air (referred to as the first portion of the yarns) is thus not overly crimped because the yarns are free to expand unimpeded by the interior walls of the stuffer box. In conjunction, the portion of the yarns remaining within the stuffer box after the first portion of the yarns is blown out (referred to as the second portion of the yarns) has an increased volume to expand. Thus, the present invention reduces the degree of crimping of both the first and second portions of the yarns since the first portion that is blown out is free to expand and the second portion that remains within the stuffer box has more volume into which it may expand after the first portion is blown out.

Accordingly, by using the present invention, the yarn located within and removed from the stuffer box at and after the time of shutdown maintains a texture closer to that of the yarns processed in the stuffer box during normal operations. Any light steaks that do exist when the manufacturing operations resume are shorter in length compared to not using the present invention. That is, the longitudinal or warp length of the tufted carpet that is unacceptable is reduced in size using the present invention compared to using previous industry practices of leaving all portions of the yarn within the stuffer box during a shutdown. Thus, compared to the prior art practices, the present invention reduces waste by eliminating or minimizing the quantity of unacceptable carpet that exists after a shutdown of the production line.

Without using the present invention, in contrast, none of the yarns remaining within the interior of the stuffer box after shutdown will be removed during the period of the shutdown and thus will be subject to greater pressures from the adjacent yarns. These greater pressures increase the number of elbows and result in more texture in the yarn. As noted above, compared to other yarns processed by the stuffer box during normal operations, the more textured yarn reflects more light and thus appears as a discoloration in the carpet, resulting in an unacceptable product that cannot be sold to consumers.

DETAILED DESCRIPTION OF THE INVENTION

Figure 1:
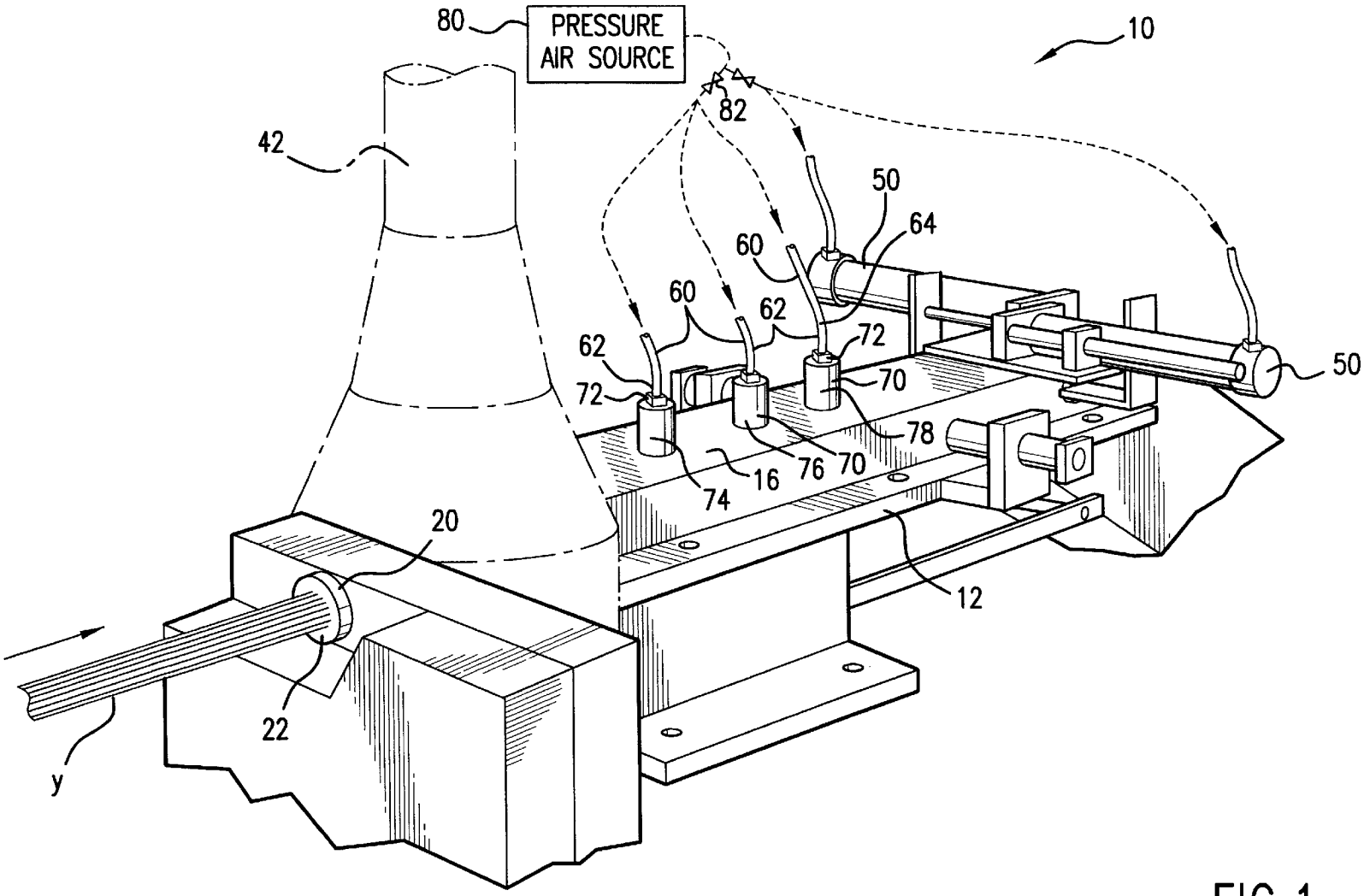
FIG. 1 is perspective view partially in schematic of an embodiment of the stuffer box of the present invention.

The present invention is more particularly described in the following detailed description of embodiments of the invention that are intended as illustrative only since numerous modifications and variations will be apparent to those skilled in the art. It is to be understood that this invention is not limited to specific methods or equipment, which may, of course, vary from the specific embodiment disclosed herein. It is also to be understood that the terminology used is for the purpose of describing particular embodiments only and is not intended to be limiting. Also, "a," "an," or "the" can mean one or more, depending upon the context in which it is used.

Addressing the present invention more specifically, the method and apparatus are described below in the context of an exemplary embodiment using a Superba® series 57774 stuffer box that process yarns formed of DuPont's 1230 fibers. However, as one skilled in the art will appreciate, the present invention encompasses more than this exemplary embodiment, in which similar engineering principles apply for different systems.

Referring generally now to FIGS. 1–4, the exemplary stuffer box 10 used with the present invention includes an exterior 12, an interior 14, a top surface 16, an inlet 20 of a size to allow a plurality of yarns Y to enter the interior 14, and an outlet 30 through which the yarns Y may exit the interior 14. The interior 14 of the stuffer box 10 is also known as the crimping chamber, which is the location where the yarns Y obtain their elbows and other texturing.

Figure 2:
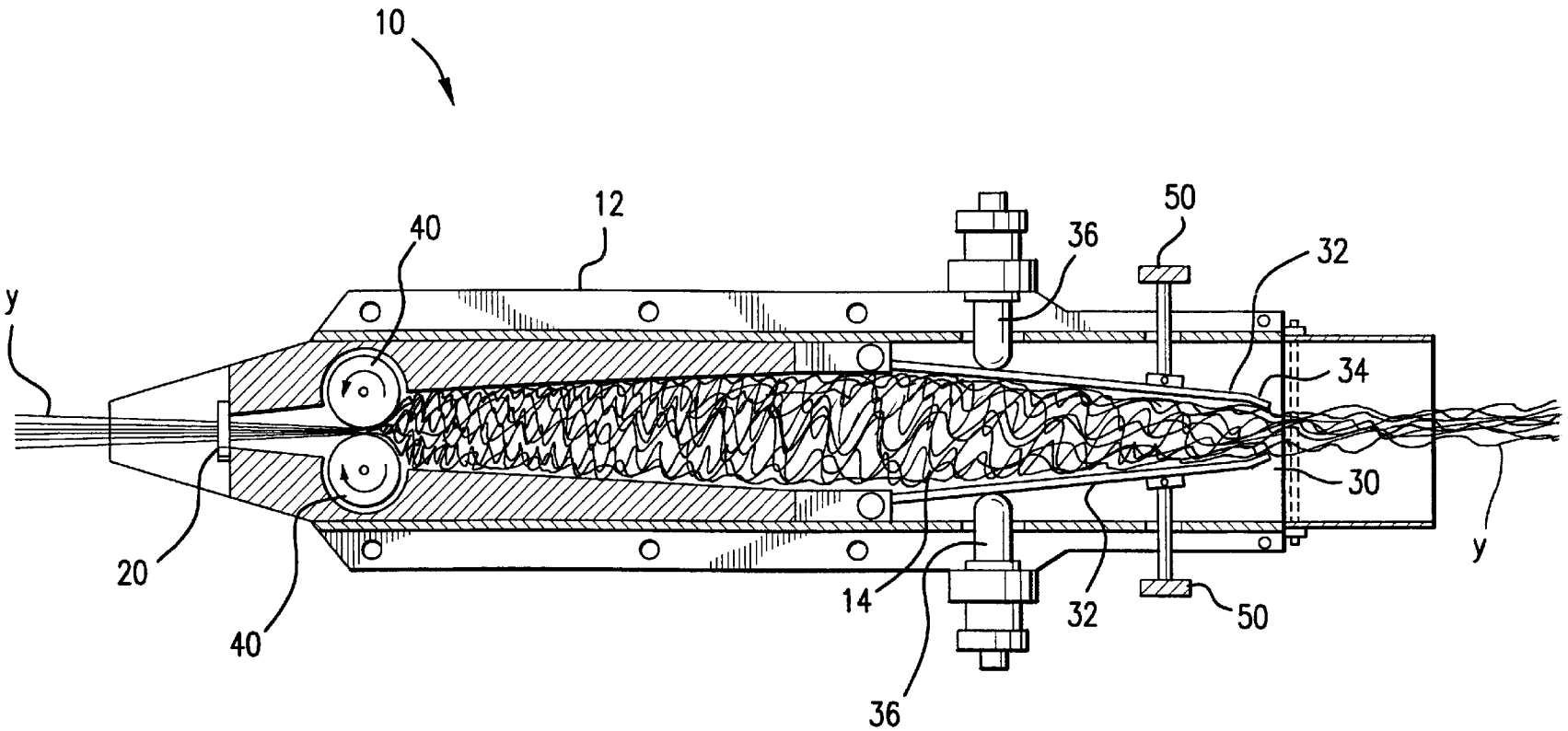
FIG. 2 is a top cross-sectional view of the stuffer box of FIG. 1, showing the interior components of the stuffer box during normal operations.

Referring specifically to FIG. 1, the inlet 20 of the stuffer box 10 is shown as a false twist inlet 22 that has multiple openings, in which each opening allows some of the individual yarns Y to pass therethrough into the interior 14 of the stuffer box 10. The false twist inlet 22 rotates or twists back and forth as the yarns Y enter to start the texturing process. Referring now to FIGS. 1 and 2, after passing through the inlet 20, the yarns Y are then engaged by a pair of counter-rotating crimping (or nip) rolls 40 and fed into the interior 14 of the stuffer box 10, in which the rotating rolls 40 are cooled by a blower (not shown) directed using a blower hood 42. An alternative stuffer box design is shown in U.S. Pat. No. 3,859,695 (incorporated herein in its entirety), in which the inlet to the enclosed interior of the stuffer box is just past crimping rollers and does not include a false twist inlet.

Figure 3:
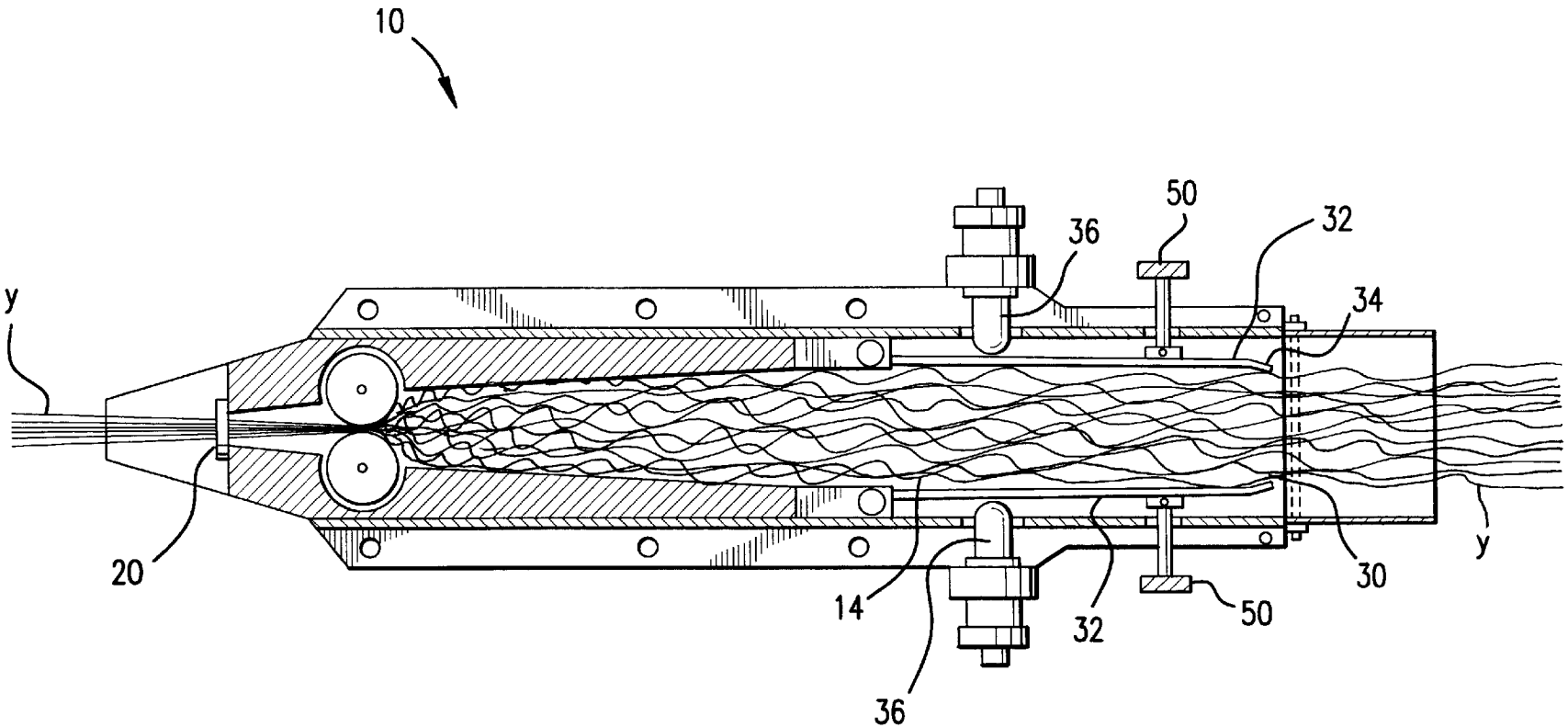
FIG. 3 is a top cross-sectional view of FIG. 2, showing the stuffer box shortly after shutdown of normal operations.
Figure 4:
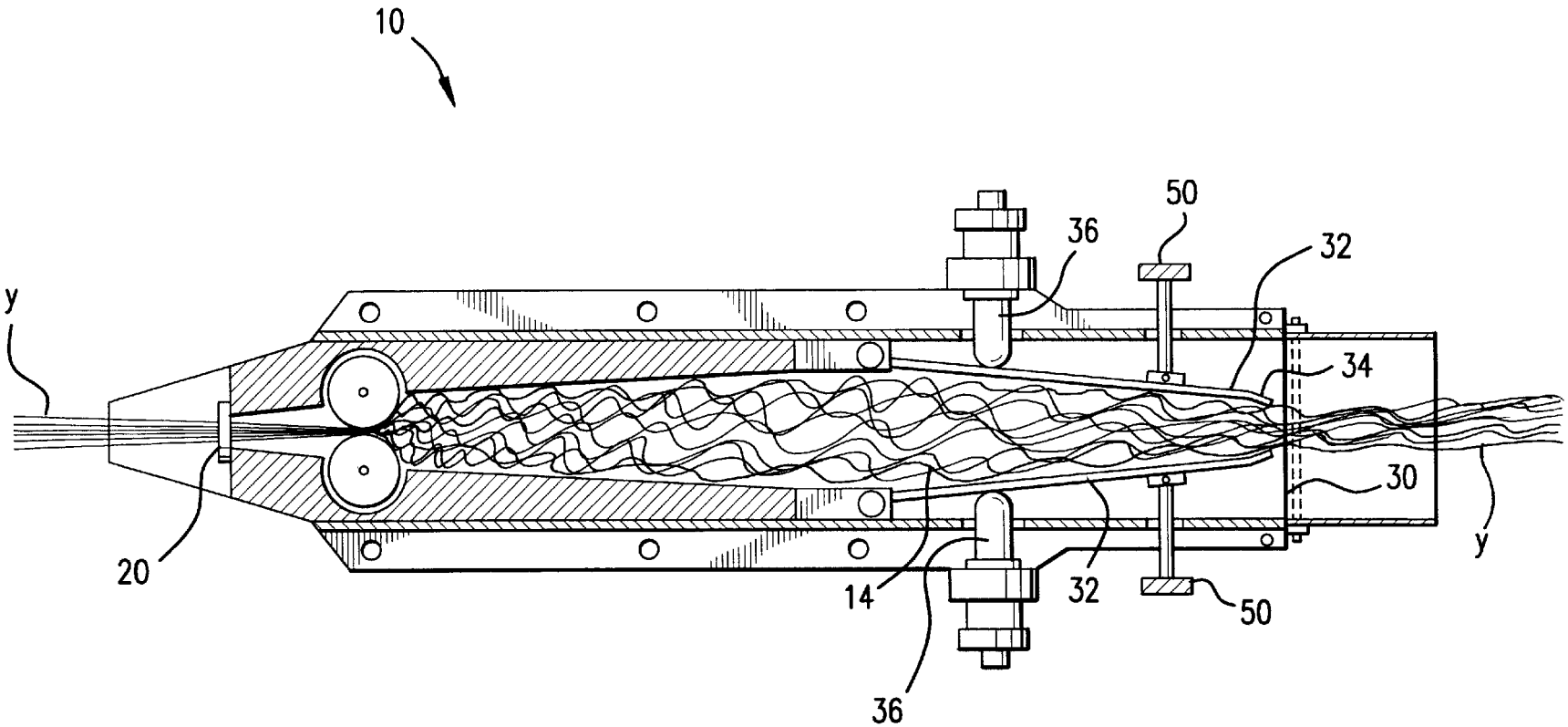
FIG. 4 is a top cross-sectional view of FIG. 3, showing the stuffer box after the process of the present invention has been completed.

The outlet 30 of the illustrated stuffer box 10 includes at least one movable flapper door 32, which is also referred to as a hinged flap, shutter, or the like. Referring now to FIGS. 2–4, there are two flapper doors 32 shown. Each flapper door 32 at least partially defines the opening size of the outlet 30 and each flapper door 32 can be moved between an open position and a closed position. The open position widens the opening size of the outlet 30 compared to the closed position.

To widen the opening size of the outlet 30, at least one of the flapper doors 32 is moved so that its trailing edge 34 shifts outwardly away from the center of the interior 14 of the stuffer box 10, which increases the opening size of the outlet 30. FIGS. 2 and 3 illustrate this shift, in which both flapper doors 32 have been moved outwardly from FIG. 2 to FIG. 3 to increase the opening size of the outlet 30 of the stuffer box 10.

The present invention preferably include a means for moving the flapper doors 32 between the open and closed positions. In the illustrated embodiment, the flapper doors 32 are normally held in the closed position during operations by bullets 36, which are springs that bias the flapper doors 32 to the closed position. To open the flapper doors 32, the illustrated embodiment includes an actuator 50 shown in FIGS. 1–4 connected to each flapper door 32 that pulls that door to the opened position by overcoming the biasing force of the bullets 36. The actuator 50 can be powered by pneumatic pressure, hydraulic pressure, electrical energy, mechanical force, or other means known to those skilled in the art. As illustrated, the actuator 50 is pneumatically operated by air that is maintained at a pressure of approximately fifteen (15) pounds per square inch gauge ("psig"), in which air pressure is applied to move the flapper door to the open position (FIG. 3) and the pressure is later released causing the flapper door to return to its normally-closed position (FIG. 4) as a result of the biasing force of the bullet 36.

Other designs are contemplated for controlling the dimension of the opening size of the outlet 30 of the stuffer box 10. As one example, the illustrated embodiment may use only a single moving flapper door 32 instead of the two shown in FIGS. 2–4. Each flapper door 32 does not necessarily need to be biased to the closed position by using spring force, but instead could be hinged and urged to the closed position by a force, such as gravity or a pneumatic system, similar to the stuffer box disclosed in U.S. Pat. No. 3,859,695 having a "discharge regulating means." Still another design may use flapper doors that move between the open and closed position by an air cylinder, a hydraulic cylinder, a solenoid, an electric switch, or the like. That is, the actuator, for example, can be an electric solenoid that moves between the open and the closed positions, either against a biasing force or alternatively without a spring urging the flapper door 32 to the closed position. Still other embodiments are contemplated, such as a circular outlet 30 opening that can be opened and closed similar to the operation or dialation of a camera lens. One skilled in the art will appreciate that other components may similarly be used to perform the step of increasing and decreasing the opening size of the outlet 30 of the stuffer box 10.

The stuffer box 10 of the present invention preferably also includes at least one conduit, and FIG. 1 shows three such conduits in the exemplary device. Each conduit 60 has an influent end, an effluent end 62, and a body 64 extending between the influent and effluent ends. The body 64 should be substantially leak proof so that approximately the same volume of a fluid that enters the influent end per a given time period concurrently exits the effluent end 62. In the exemplary embodiment, the conduit is quarter (¼) inch hose, so its inner diameter is three-sixteenths (3⁄16) of an inch.

It is preferred that the conduit 60 be joined to a connector 70 formed through a portion of the stuffer box 10, preferably through the top surface 16. Each connector 70 has an attachment end 72 adapted to engage the effluent end 62 of the conduit 60 and to allow fluid communication between the conduit 60 and the interior 14 of the stuffer box 10. The effluent end 62 of the conduit 60 thus is in fluid communication with the interior 14 of the stuffer box 10 through the connector 70. One skilled in the art will appreciate that the juncture for each connector 70 with the interior 14 of the stuffer box 10 should be thoroughly sanded to prevent the yarns Y from catching on burrs or the like during operations.

Each connector 70 is also preferably positioned intermediate the inlet 20 and outlet 30 of the stuffer box 10, i.e., downstream of the inlet 20 and upstream the outlet 30. Each connector 70 is oriented so that fluid exiting from conduit 60 through the connector 70 travels longitudinally toward the outlet 30 of the stuffer box 10. Thus, a pressurized fluid that enters the influent end of the conduit 60 travels through its body 64, exits out of the effluent end 62, passes through the connector 70, and enters into the interior 14 of the stuffer box 10 directed toward the outlet 30. Thus, injecting a fluid into the influent end results in an approximately simultaneous discharge of fluid into the interior 14 of the stuffer box 10 via the connector 70 and the conduit 60.

In the illustrated embodiment shown in FIGS. 1–4, the stuffer box 10 includes three conduits 60 and three longitudinally spaced-apart connectors 70 penetrating through the top surface 16 of the stuffer box 10. The three connectors 70 are referred to as the first connector 74 (which is closest to the inlet 20), the second connector 76 (which is the middle connector), and the third connector 78 (which is closest to the outlet 30). In the exemplary embodiment, the first connector 74 is positioned six and three-quarter (6¾) inches from the flapper door hinge, the second connector 76 is positioned four (4) inches from the flapper door hinge, and the third connector 78 is positioned one and a half (1½) inches from the flapper door hinge.

The present invention preferably further includes a pressurized fluid source 80 in fluid communication with the conduit 60. The desired system uses a pressurized source 80 of air, which may take the form of an air compressor, a tank of compressed or pressurized air, or the like. Also, it is within the scope of the invention to use other fluids, such as nitrogen or other gases. The exemplary embodiment uses the output of an air compressor, in which the air is at approximately ambient or room temperature.

The present invention also preferably includes at least one valve 82 disposed intermediate the pressurized air source 80 and the effluent end 62 of the conduit 60. Each valve 82 is movable between an open and a closed position. In the closed position, the pressurized air source 80 is not in fluid communication with the interior 14 of the stuffer box 10, i.e., no air is flowing through the conduits 60. In the open position, air from the pressurized air source 80 flows through the body 64 of the conduit 60 from the pressurized air source 80 to enter the interior 14 of the stuffer box 10.

For the exemplary embodiment, the pressure of the air from the pressurized source 80 exiting the effluent end 62 of the conduit 60 into the interior 14 of the stuffer box 10 is preferably between approximately nine (9) and fifteen (15) psig, more preferably between approximately ten (10) and thirteen (13) psig, and most preferably at approximately eleven (11) or twelve (12) psig.

As one skilled in the art will appreciate, the present invention can function without including the described conduits, connectors, and pressurized air source, but these components facilitate the ease with which the present invention may be constructed and operated. For example, pressurized gas may alternatively be injected through the side or bottom surface of the stuffer box, but it is believed that these designs are not as efficient as injecting air through the top surface. As another contemplated embodiment, air or other fluid can be injected through the inlet of the stuffer box, instead of using the connectors penetrating through the stuffer box downstream of the inlet. These alternative embodiments may involve injecting the pressurized fluid either as part of an automated system or manually.

During normal operations, the process of the present invention involves continuously moving the yarns Y through the interior 14 of the stuffer box 10. As shown in FIG. 2, the yarns Y enter the inlet 20, pass through the counter-rotating crimping rolls 40, compress within the interior 14—a confined volume—and then exit out of the outlet 30 of the stuffer box 10. Thus, the yarns Y, before exiting from the outlet 30, are caused to be folded and crimped to obtain the desired "texture" while within and passing through the interior 14 of the stuffer box 10. The yarns Y are also heat set to make the texturing of a lasting nature, in which the heat-set step may occur while the yarns Y are within the interior 14 of the stuffer box 10 or, more commonly, after the yarns exit from the outlet 30 of the stuffer box 10.

The stuffer box and heat setting processes result in the yarns Y being uniformly textured since each portion of the yarn Y has an equal residence time within the interior 14 of the stuffer box 10 to obtain the same amount of texturing. As noted above, however, sometimes the processing line must be stopped for various planned or unplanned reasons. Once the production line stops, the method of the present invention becomes more consequential. Specifically, some of the yarns Y inherently remain within the interior 14 of the stuffer box 10 after the production line stops. In fact, usually such a quantity of yarn Y remains within the interior 14 of the stuffer box 10 that those yarns become overly textured unless the present invention is utilized. FIG. 2 illustrates a sample compacting of the yarns within the interior 14 of the stuffer box 10 during normal operations.

To address this issue, the process of the present invention increases the opening size of the outlet 30 of the stuffer box 10, which, in the exemplary embodiment, involves moving the trailing edge 34 of at least one of the two flapper doors 32 outwardly as shown in FIG. 3. Preferably, a controller (not shown) already used in conjunction with the production line, such as a PLC, computer system, microprocessor, or other electronic processing unit, sends a signal within one second of the line being shutdown to move each of the two flapper doors 32 from the closed position to the open position using the actuators 50 operated by pneumatic pressure. The controller preferably begins this operating sequence upon sensing a loss of power or any signal relating to stopping operations of the processing line.

In the exemplary embodiment, an air pressure of fifteen psig is sufficient to overcome the biasing force of the respective bullets 36 and to open the flapper doors 32. Of course, the step of increasing the opening size of the outlet 30 of the stuffer box 10 can be performed manually, but having the process automated is preferred, particularly if an operator is not nearby when the shutdown occurs.

When the opening size of the outlet 30 has been increased, the exemplary process involves injecting the pressurized air through a portion of the interior 14 of the stuffer box 10. The pressurized air is injected approximately one second after the flapper doors 32 have been repositioned to increase the opening size of the outlet 30 (or approximately two seconds after the shutdown occurs) in the exemplary embodiment. It is preferred that the controller initiates the initial injection of pressurized air by moving the valve 82 to allow the air to flow from the pressurized air source 80, through the body 64 of the at least one of the three conduits 60, and into the interior 14 of the stuffer box 10. In the exemplary embodiment, the initial air injection lasts just less than one second, after which time the controller repositions the valve 82 to its normally-closed position.

The pressurized air enters the interior 14 of the stuffer box 10 and is directed to flow longitudinally toward its outlet 30.

That is, as discussed above, the connectors 70 are oriented such that the exiting air is directed longitudinally toward the outlet 30 of the stuffer box 10, thus entraining a portion of the yarns Y that are carried through and out of the outlet 30 of the stuffer box 10, i.e., a portion of the yarns Y initially within the interior 14 of the stuffer box 10 exits the interior 14 through the open flapper doors 32. By pushing a portion of the yarn Y out of the interior 14 of the stuffer box 10, the yarn both remaining within the interior 14 and pushed outside the stuffer box 10 are loosened and free to expand. Thus, the fluid flow must be sufficient to remove at least a portion of the yarn Y that remains within the stuffer box 10 after shutdown. Comparing FIG. 2 to FIG. 3 shows an initial portion of the yarns Y having been removed from the interior 14 of the stuffer box 10.

However, if too much yarn Y is pushed out of the interior 14 during shutdown, no "reservoir" of yarn remains so that, upon restarting, the initially processed yarns Y obtain insufficient texturing and appear as dark streaks when tufted into a carpet. It is believed that approximately fifty percent (50%) of the yarns Y should be forced out of the interior 14 of the stuffer box 10 after shutdown to show improvement in the final product. It is further believed that approximately seventy-five to eighty percent (75—80%) of the yarns Y should be pushed out for optimal operation of the exemplary embodiment.

One skilled in the art will appreciate that the steps of opening the flapper doors 32 and injecting the air may be performed concurrently or simultaneously. For example, the controller may have the opening and injecting processes occur approximately simultaneously with each other. However, for the exemplary embodiment, it has been found that it is best to perform the step of increasing the opening size of the outlet 30 prior to injecting the pressurized air.

It is also preferred that the pressurized air is injected multiple times, in which the air injection step preferably occurs at least two times and more preferably occurs three separate times. That is, the process of the present invention preferably involves injecting pressurized air for a separate, second time through the interior 14 of the stuffer box 10 so that the air entrains some of the yarns Y remaining within the interior 14 of the stuffer box 10 after the first air injection. After this second pressurized air injection is stopped, the process preferably repeats a third time, in which pressurized air is again injected for a predetermined duration through a portion of the interior 14 of the stuffer box 10 to entrain some of the yarns Y still remaining within the interior 14 of the stuffer box 10. It is also preferred that approximately slightly less than one second passes between each instance of starting the injection of the air and stopping the injection or, stated differently, that the initial, second, and third injections of the air each lasts approximately one second or less.

In addition to the temporal injection sequence, the present invention also contemplates changing the physical injection locations for the initial, second, and third injections. Preferably, the initial injection occurs through all three conduits 60 and respective connectors 70 simultaneously. Nonetheless, it is contemplated injecting air initially through the third connector 78 only, the second injection would then occur through the second connector 76 only, and last the third injection would occur through the first connector 74 only. Thus, the injections start closest to the outlet 30 of the stuffer box 10 and move closer to the inlet 20 each injection. The present invention may also include other injection sequences based on the physical the locations of the injections. For example, the sequential injection described above may be reversed, if desired, so that the injections start closest to the inlet 20 of the stuffer box 10 and move closer to the outlet 30 each injection. Furthermore, regardless of the injection point(s) used, it is also contemplated injecting air having different pressures each time, i.e., at fourteen (14) psig for the initial injection, at twelve (12) psig for the second injection, and at eleven (11) psig for the final injection.

As noted above, the injection times and pressures may be different for different stuffer boxes or different fibers, but one skilled in the art will be able to determine the correct processing criteria mathematically or empirically. Without being limited to any theory of operation, it is believed that an increased velocity of the compressible fluid (i.e. air) flowing through the interior of the stuffer box improves the ability of that flowing fluid to entrain and carry some of the yarn out of the interior of the stuffer box. The velocity of the airflow is also understood to be a function of the volumetric flow rate and pressure of the flowing air. Accordingly, since precisely calculating the desired air pressure and velocity with a compressible fluid may be difficult—a task further complicated by trying to quantify the mass of yarn within the flow path of the air—it may be easier to determine empirically by trial-and-error tests the desired injection sequence and duration. These empirical tests for the Superba® series 57774 stuffer box that process yarns formed of DuPont's 1230 fibers resulted in the preferred exemplary process discussed above, in which there are three sequential injections of slightly less than one (1) second each being injected simultaneously through the three different conduits 60.

As shown in FIG. 4, once the last pressurized air injection is completed—whether that occurs after one, two, three, or more injections—it is preferred to decrease the opening size of the outlet 30. In the exemplary embodiment, the opening size of the outlet 30 is decreased by moving the flapper doors 32 approximately four seconds after the process starts, i.e., four seconds after the opening size of the outlet 30 is increased. The flapper doors 32 are preferably returned to the initial position that is used during the processing of the yarns Y before the shutdown. This can be performed by the controller bleeding off the pneumatic pressure to the actuator 50 so that the biasing force of the bullets 36 return the respective flapper doors 32 to their initial, normal operating positions, which is shown in FIG. 4. Thus, without any operator interface, the exemplary embodiment of the present invention completes and resets the stuffer box 10 to a condition for resuming normal operations within a matter of seconds. This quick operation is advantageous for the yarn processor because the stuffer box will be setup for operations within five seconds and, accordingly, will not hinder restarting operations of the production line.

The present invention, accordingly, removes a portion of the yarn located within the stuffer box at the instance of shutdown and this removal of the yarn allows for expansion of all portions of the yarn—yarn both remaining within the stuffer box and pushed outside the interior of the stuffer box. As a result of the ability of all the yarn to expand, the yarn's texture remains closer to that of the yarns processed in the stuffer box during normal operations. Any light streaks that do exist when the manufacturing operations resume are shorter in length compared to not using the present invention.

In fact, compared to the prior art practices, the present invention reduces waste by eliminating or minimizing the quantity of unacceptable carpet that exists after a shutdown. It has been found that using the present invention has contributed to reducing the off-quality percentage of carpet manufactured using yarns process with the present invention to about half of the waste that exists when using the prior art techniques. This reduction in carpet waste results in savings to carpet manufacturers of thousands of dollars, the exact value of which is a function of the carpet manufacturer's production volume.

Although the present invention has been described with reference to specific details of certain embodiments thereof, it is not intended that such details should be regarded as limitations upon the scope of the invention except as and to the extent that they are included in the accompanying claims.

What is claimed is:

1. A method for texturing yarns, comprising:

a. moving the yarns through an interior of a stuffer box, the stuffer box having an inlet through which the yarns enter the interior and an outlet through which the yarns exit the interior, the outlet having an opening size partially defined by at least one movable flapper door;

b. stopping the moving yarns so that some of the yarns remain within the interior of the stuffer box;

c. increasing the opening size of the outlet of the stuffer box by moving at least one flapper door; and d. injecting a fluid through a portion of the interior of the stuffer box, the fluid entraining some of the yarns remaining within the interior of the stuffer box to move at least a portion of the yarns out of the interior of the stuffer box.

2. The method of claim 1, wherein the injection of the fluid lasts less than one second.

3. The method of claim 1, further comprising:

e. stopping the injection of the fluid.

4. The method of claim 3, further comprising:

f. for a second time, injecting the fluid through a portion of the interior of the stuffer box, the fluid entraining some of the yarns remaining within the interior of the stuffer box;

g. stopping the second injection of the fluid;

h. for a third time, injecting the fluid through a portion of the interior of the stuffer box, the fluid entraining some of the yarns remaining within the interior of the stuffer box; and i. stopping the third injection of the fluid.

5. The method of claim 4, further comprising, after stopping the third injection of the fluid, decreasing the opening size of the outlet by moving at least one flapper door.

6. The method of claim 4, wherein the initial, second, and third injections of the fluid each lasts less than one second.

7. The method of claim 5, wherein the opening size of the outlet is decreased approximately four seconds after the opening size of the outlet is increased.

8. The method of claim 5, wherein the opening size of the outlet is decreased to a size approximately the same as during the initial moving of the yarns.

9. The method of claim 3, further comprising repeatedly starting the injection of the fluid and then stopping the injection the fluid.

10. The method of claim 9, wherein less than one second passes between each instance of starting the injection of the fluid and stopping the injection.

11. The method of claim 9, wherein the injection of the fluid is started and stopped at least two times.

12. The method of claim 11, wherein the injection of the fluid is started and stopped three times.

13. The method of claim 12, further comprising, after stopping the third injection of the fluid, decreasing the opening size of the outlet by moving at least one of the flapper doors.

14. The method of claim 1, wherein the fluid is air provided from a source of pressurized air.

15. The method of claim 1, wherein when injecting the fluid through the interior of the stuffer box, the fluid enters proximate to the inlet of the stuffer box and flows through the stuffer box to exit the outlet of the stuffer box.

16. The method of claim 1, wherein the injecting of the fluid causes the portion of the yarns moved out of the interior of the stuffer box to exit through the outlet of the stuffer box.

17. The method of claim 1, wherein increasing the opening size of the outlet of the stuffer box occurs before injecting the fluid through a portion of the interior.

18. The method of claim 1, wherein increasing the opening size of the outlet of the stuffer box occurs approximately simultaneously with injecting the fluid through a portion of the interior.

19. The method of claim 1, wherein increasing the opening size of the outlet of the stuffer box occurs within one second of stopping the moving yarns.

20. The method of claim 1, wherein when injecting the fluid through the interior of the stuffer box, the fluid enters the interior at three separate locations approximately simultaneously.

21. A method for texturing yarns, comprising the steps of:

a. moving the yarns through an interior of a stuffer box, the stuffer box having an inlet through which the yarns enter the interior and an outlet through which the yarns exit the interior, the outlet having an opening size partially defined by at least one movable flapper door;

b. stopping the moving yarns so that some of the yarns remain within the interior of the stuffer box;

c. after the stopping step, increasing the opening size of the outlet of the stuffer box by moving at least one flapper door;

d. injecting a fluid through a portion of the interior of the stuffer box, the fluid entraining some of the yarns remaining within the interior of the stuffer box to move at least a portion of the yarns out of the interior of the stuffer box; and e. after the injecting step, stopping the injection of the fluid.

22. The method of claim 21, further comprising:

f. for a second time, injecting the fluid through a portion of the interior of the stuffer box, the fluid entraining some of the yarns remaining within the interior of the stuffer box;

g. after the second injecting step, stopping the second injection of the fluid;

h. for a third time, injecting the fluid through a portion of the interior of the stuffer box, the fluid entraining some of the yarns remaining within the interior of the stuffer box; and i. after the third injecting step, stopping the third injection of the fluid.

23. The method of claim 22, further comprising, after the third stopping step, decreasing the opening size of the outlet by moving at least one flapper door.

24. The method of claim 23, wherein the decreasing step occurs approximately four seconds after the increasing step.

25. The method of claim 21, wherein the increasing step occurs before the injecting step.

26. The method of claim 21, wherein the increasing step occurs approximately simultaneously with the injecting step.

27. The method of claim 21, wherein the injecting step causes the portion of the yarns moved out of the interior of the stuffer box to exit through the outlet of the stuffer box.

28. The method of claim 21, wherein the increasing step occurs within one second of beginning of the stopping step.

29. The method of claim 21, wherein when injecting the fluid through the interior of the stuffer box, the fluid enters the interior at three separate locations approximately simultaneously.

30. A method for texturing yarns, comprising:

a. moving the yarns through an interior of a stuffer box, the stuffer box having an inlet through which the yarns enter the interior and an outlet through which the yarns exit the interior, the outlet having an opening size;

b. stopping the moving yarns so that some of the yarns remain within the interior of the stuffer box;

c. increasing the opening size of the outlet; and d. injecting a fluid through a portion of the interior of the stuffer box, the fluid entraining some of the yarns remaining within the interior of the stuffer box to move at least a portion of the yarns out of the interior of the stuffer box.

31. The method of claim 30, further comprising:

e. stopping the injection of the fluid.

32. The method of claim 31, further comprising:

f. for a second time, injecting the fluid through a portion of the interior of the stuffer box, the fluid entraining some of the yarns remaining within the interior of the stuffer box;

g. stopping the second injection of the fluid;

h. for a third time, injecting the fluid through a portion of the interior of the stuffer box, the fluid entraining some of the yarns remaining within the interior of the stuffer box; and i. stopping the third injection of the fluid.

33. The method of claim 32, further comprising, after stopping the third injection of the fluid, decreasing the opening size of the outlet.

34. A texturizing apparatus, comprising:

a. a stuffer box having at least one movable flapper door, an interior, an inlet of a size to allow a plurality of yarns to enter the interior, and an outlet through which the yarns may exit the interior, the outlet having an opening size partially defined by the at least one movable flapper door;

b. at least one actuator, each actuator coupled to one respective flapper door for moving that flapper door between an open position and a closed position, in which the open position widens the opening size of the outlet compared with the closed position;

c. at least one conduit, each conduit having an influent end, an effluent end, and a body extending between the influent and effluent ends, wherein the effluent end is in fluid communication with the interior of the stuffer box so that pressurized fluid entering the influent end of the conduit travels through the body and exits out of the effluent end into the interior of the stuffer box.

35. The apparatus of claim 34, wherein the stuffer box further comprises:

a. a pressurized air source containing air, the pressurized air source in fluid communication with the influent end of the conduit; and b. at least one valve disposed intermediate the pressurized air source and the effluent end of the conduit, each valve movable between a closed position, in which the pressurized air source is not in fluid communication with the interior of the stuffer box, and an open position, in which air from the pressurized air source flows through the body of the conduit from the pressurized air source and into the interior of the stuffer box so that the air exits the conduit into the interior of the stuffer box.

36. The apparatus of claim 35, wherein when each valve is in the open position, the air from the pressurized air source exits the effluent end of the conduit into the interior of the stuffer box at approximately eleven pounds per square inch.

37. The apparatus of claim 36, further comprising at least one connector formed through a portion of the stuffer box, each connector having an attachment end adapted to engage the effluent end of the conduit, the connector providing fluid communication between the conduit and the interior of the stuffer box.

38. The apparatus of claim 37, wherein the stuffer box has a top surface, and wherein the connector is disposed through the top surface.

39. The apparatus of claim 38, wherein each connector is positioned proximate to the inlet of the stuffer box and oriented so that the air exiting the conduit travels toward the outlet of the stuffer box.

40. The apparatus of claim 39, wherein there are three conduits and three connectors, the three connectors longitudinally spaced apart and disposed intermediate the inlet and the outlet of the stuffer box.

41. The apparatus of claim 34, wherein there are two movable flapper doors.

42. A texturizing apparatus, comprising:

a. a plurality of yarns;

b. a stuffer box having at least one movable flapper door, an interior, an inlet of a size to allow the plurality of yarns to enter the interior, and an outlet through which the yarns may exit the interior, the outlet having an opening size partially defined by the at least one movable flapper door;

c. at least one actuator, each actuator coupled to one respective flapper door for moving that flapper door between an open position and a closed position, in which the open position widens the opening size of the outlet compared with the closed position; and d. at least one conduit, each conduit having an influent end, an effluent end, and a body extending between the influent and effluent ends, wherein the effluent end is in fluid communication with the interior of the stuffer box so that pressurized fluid entering the influent end of the conduit travels through the body and exits out of the effluent end into the interior of the stuffer box to interface with the yarns therein.

43. A texturizing apparatus, comprising:

a. a stuffer box having at least one movable flapper door, an interior, an inlet of a size to allow a plurality of yarns to enter the interior, and an outlet through which the yarns may exit the interior, the outlet having an opening size partially defined by the at least one movable flapper door;

b. means for moving the flapper door between an open position and a closed position, in which the open position widens the opening size of the outlet compared with the closed position; and c. at least one conduit, each conduit having an influent end, an effluent end, and a body extending between the influent and effluent ends, wherein the effluent end is in fluid communication with the interior of the stuffer box so that pressurized fluid entering the influent end of the conduit travels through the body and exits out of the effluent end into the interior of the stuffer box to interface with the yarns therein.

* * * * *